United States Patent [19]

Alexandrov et al.

[11] Patent Number: 4,812,608

[45] Date of Patent: Mar. 14, 1989

[54] OVEN FOR THERMO-MAGNETIC TREATMENT OF TOROIDAL COILS OF AMORPHOUS FERRO-MAGNETIC RIBBON MATERIAL

[75] Inventors: Nicolas Alexandrov, St-Bruno; Normand Chrétien; Jean-Luc Fihey, both of Ste-Julie, all of Canada

[73] Assignee: Hydro-Quebec, Quebec, Canada

[21] Appl. No.: 171,809

[22] Filed: Mar. 22, 1988

[51] Int. Cl.[4] ..... H05B 6/10

[52] U.S. Cl. ..... 219/10.75; 219/10.57; 219/10.491; 219/10.67; 148/121

[58] Field of Search ..... 219/10.57, 10.43, 10.491, 219/10.67, 10.75, 10.71; 148/103, 108, 121, 150

[56] References Cited

U.S. PATENT DOCUMENTS

| | | | |
|---|---|---|---|
| 4,013,742 | 3/1977 | Lang | 219/10.491 |
| 4,281,234 | 7/1981 | Dohogne | 219/10.57 X |
| 4,355,221 | 10/1982 | Lin | 219/10.75 X |
| 4,355,222 | 10/1982 | Geithman et al. | 219/10.57 |
| 4,602,140 | 7/1986 | Sobolewski | 219/10.75 X |

*Primary Examiner*—Philip H. Leung

*Attorney, Agent, or Firm*—Oblon, Fisher, Spivak, McClelland & Maier

[57] ABSTRACT

An oven for thermo-magnetic treatment of toroidal coils of amorphous ferro-magnetic ribbon material whereby to improve the eddy current and hysteresis losses thereof for utilization of such coils in a distribution transformer construction. The oven comprises a housing formed as an annular chamber with thermo insulating material disposed at the interior of the chamber. A wire coil is wound about the annular chamber through the inner central passage thereof whereby to generate a magnetic field about the housing to orient the ferro-magnetic domains in the amorphous ribbon material being heat treated in the chamber. At least one toroidal coil is disposed within the chamber between a pair of heating plates to which controlled heat is applied. Preferably, the chamber is evacuated or an inert gas is provided therein.

12 Claims, 2 Drawing Sheets

OVEN FOR THERMO-MAGNETIC TREATMENT OF TOROIDAL COILS OF AMORPHOUS FERRO-MAGNETIC RIBBON MATERIAL

BACKGROUND OF INVENTION (a) Field of the Invention

The present invention relates to a novel oven construction for thermal-magnetic treatment of toroidal coils of amorphous ferro-magnetic ribbon material whereby to improve the eddy current and hysteresis losses thereof for utilizing such coils in a distribution transformer construction.

(b) Description of Prior Art

In my U.S. application Ser. No. 632,065 abandoned in favour of continuation application Ser. No. 003,367, I disclose the construction of a novel distribution transformer wherein the magnetic circuit is formed by one or more toroidal coils made from ribbon of ferro-magnetic amorphous steel material. Such distribution transformers need not be immersed in an insulating oil and thus are not inflammable or vulnerable to fire or explosion in the event of defects or over-heating of the transformer. Furthermore, there is a considerable weight reduction achieved by my novel transformer construction. With prior art distribution transformers, the hysteresis loss as well as eddy current losses are continuous and relatively large. By utilizing my magnetic circuit, and particularly comprising a toroidal coil of amorphous ferro-magnetic ribbon material, I overcome these disadvantages. However, the coil must be treated in order to improve the eddy current and hysteresis losses of the material and this is achieved, in a very efficient manner, by the use of my new oven concept.

It is pointed out that with prior art ovens, it is not possible to produce thermal as well as magnetic fields to treat the coil.

SUMMARY OF INVENTION

It is therefore a feature of the present invention to provide a novel oven construction for thermo-magnetic treatment of toroidal coils of amorphous ferro-magnetic ribbon material to improve the eddy current and hysteresis losses thereof for utilization of such coils in distribution transformer construction.

It is a further feature of the present invention to provide an oven for thermo-magnetic treatment of toroidal coils of amorphous ferro-magnetic ribbon material whereby to achieve an improvement of three to five times the eddy current and hysteresis losses thereof as compared with steel ribbon made of silicium having an oriented crystal structure.

Another feature of the present invention is to provide an improved oven for thermo-magnetic treatment of toroidal coils of amorphous ferro-magentic ribbon material and wherein the oven is defined by a housing having an annular configuration to permit the application of a magnetic field in the annular chamber of the oven.

Another feature of the present invention is to provide a novel oven for thermo-magnetic treatment of toroidal coils of amorphous ferro-magnetic ribbon material and wherein one or more coils are supported inside the oven on annular heating plates to heat the coil from opposed ends thereof under controlled heat and controlled atmosphere.

According to the above features, from a broad aspect, the present invention provides an oven for thermo-magnetic treatment of toroidal coils of amorphous ferro-magnetic ribbon material whereby to improve the eddy current and hysteresis losses thereof for utilizing such coils in a distribution transformer construction. The oven comprises a housing formed of an annular chamber defined by a base portion and a detachable cover portion. A thermo insulating material is disposed over an interior surface of the base and cover portions. The annular chamber defines an open-ended central vertical passage. A coil of electrically conductive wires is disposed about the chamber and extends about the vertical cross section of said chamber through said central vertical passage to encircle the base and cover portions all along the annular chamber. The coil of conductive wire is separable by detachable connector means to permit the cover portion to be detached from the base portion. At least two annular support heater discs are provided inside the annular chamber and between which a coil of the amorphous ribbon material may be disposed for heating the toroidal windings of the ribbon material from the end edges thereof. Means is provided to apply controlled heat to the heater discs. Means is also provided to apply a current to the coil of electrically conductive wire to generate a controlled magnetic field about the chamber to orient the ferro-magnetic domains in the amorphous ribbon material when positioned in the chamber.

BRIEF DESCRIPTION OF DRAWINGS

A preferred embodiment of the present invention will now be described with reference to the examples thereof as illustrated by the accompanying drawings in which.

DESCRIPTION OF PREFERRED EMBODIMENTS

Figure 1:
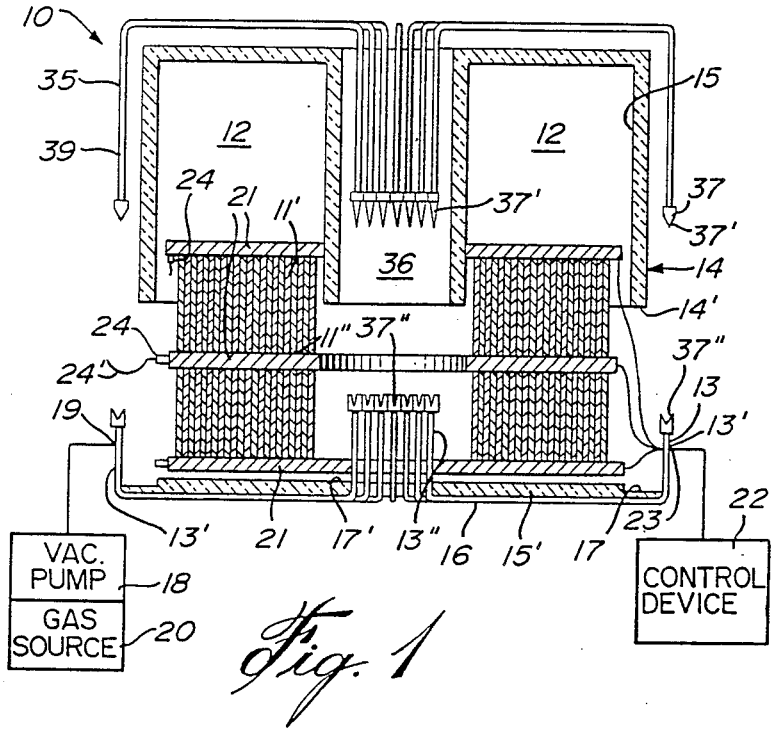
FIG. 1 is a section view illustrating the construction of the oven of the present invention and wherein the oven has a circular annular shape.
Figure 2:
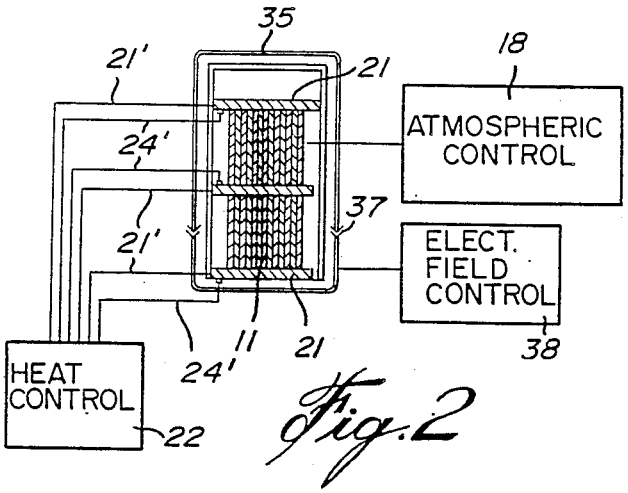
FIG. 2 is a schematic diagram showing a cross section of the side of the annular chamber illustrating the various controls associated therewith.
Figure 3:
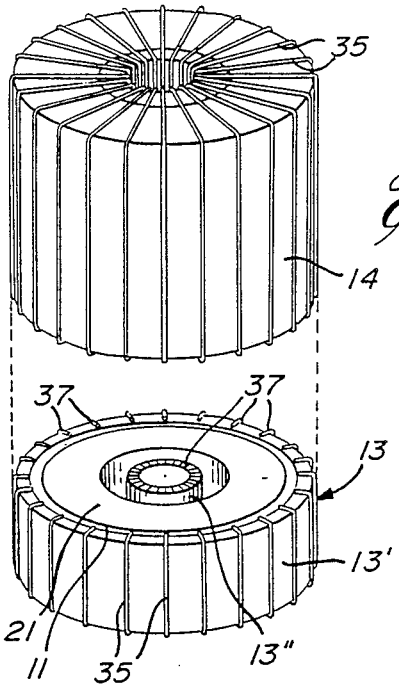
FIG. 3 is a fragmented perspective view of a circular annular oven.

Referring now to the drawings, and more particularly to FIGS. 1 to 3, there is shown generally at 10, the novel oven construction for thermo-magnetic treatment of toroidal coils 11 of amorphous ferro-magnetic ribbon material. These coils 11 consist of a very fine ribbon which is wound in a spiral and constituting a plurality of closely spaced layers 11'. These layers are utilized in the construction of the magnetic circuit of distribution transformers and supported on their bottom edges 11'' whereby to eliminate mechanical stresses on the coil. When using such coils in these transformers, it is highly desirable that the eddy current and hysteresis losses be improved. This is done by subjecting the coils to a heat and magnetic field treatment. Such treatments should all be effected under a controlled state to achieve maximum results.

As herein shown, the oven 10 comprises a housing formed as an annular chamber 12 which is defined by a base portion 13 and a detachable top or cover portion 14. A thermo insulating material 15 and 15′ is disposed along the annular walls of the cover portion 14 and the annular bottom wall 16 of the base portion 13, respectively. This thermo insulating material may be fiberglass insulation, silica insulation, or any other insulation having good thermal properties.

As show in FIG. 1, the oven defines a circular ring chamber and the base portion is shaped as an annular trough-shaped base having opposed peripheral vertical walls 13′ and 13″ to each side of the bottom wall 16. The thermo insulating material 15′ is also provided with peripheral seating notches 17 and 17′ to receive in close fit therewith the bottom edge wall 14′ of the cover portion which is also formed as an inverted trough-shaped member. The cover portion is dimensioned to be received inside the base portion in close fit therewith whereby the annular chamber 12 may be sealed. Clamps (not shown) may be provided to hold down the cover and provide a sealing fit of the insulation and cover.

The chamber 12 is also preferably evacuated by a vacuum pump 18 which is connectable to a side wall of the base or the cover portion, herein the side wall 13′ of the base, and through the insulation via a coupling 19. Alternatively, a gas source 20 could be connected to the coupling 19 whereby to inject an inert gas into the chamber whereby to promote even heating of the coils 11.

In order to provide controlled and substantially even heat of the coils 11, there is further provided within the chamber at least two annular support heater discs 21 which are each connected to an electrical power source 22 via individual wires 21′ through a suitable electrical connector 23. A thermocouple 24 is also connected to each of the discs and has an electrical connection 24′ coupled to the control circuit 22 via the connector 23 so as to sense the temperature of the discs 21 to control the current applied thereto. At least two amorphous steel coils 11 can be disposed in the oven 10 and it is within the ambit of the present invention to increase the size of the oven if it is desired to position a plurality of these coils one on top of the other. It is also pointed out that by disposing these coils on their end edge 11″, these are not subjected to mechanical stresses during this treatment as such stresses would provide defects in the ribbon layers which could result in failures when utilized in a power distribution transformer. Also, by heating the coils from the ends, the heat will be distributed axially between the layers and heat all of the windings. If the heating was not in an axial direction, then the air between the windings of the coils would provide insulation and would result in an uneven heat distribution and treatment.

Figure 5:
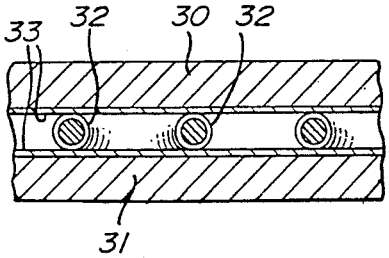
FIG. 5 is a section view of an annular support heater disc.

Referring now to FIG. 5, there is shown a section of the heater disc to illustrate the construction thereof. These discs consist of a composite annular plate comprised of a pair of metal plates 30 and 31, such a copper or aluminum plates, which are good heat conductive materials. Sandwiched between the plates 30 and 31 is a serpentine arrangement of a resistive electrical insulated heater wire 32. The wire 32 is also sandwiched between two sheets of electrical insulating material, herein two mica sheets 33. The thermocouple 24 is connected at a suitable location across the plates 30 and 31 and is not illustrated in detail hereinbelow but obvious to a person skilled in the art.

As previously described, the oven also provides for a controlled magnetic field treatment of the coils 11 whereby to orient the ferro-magnetic domains in the coil amorphous ribbon material. Although this is preferably done during the heat treatment of the coils, it may also be effected immediately after the heat treatment. This is achieved by providing a coil of electrically conductive wire (as schematically illustrated at 35) about the chamber, or to put it in other words, across the vertical cross section of the chamber and through the central vertical passage 36 whereby to encircle the base and cover portions along the annular chamber. This coil of conductive wire is separable between the cover portion 14 and base portion 13 by means of connectors 37 provided at each end of the coil windings 35. These connectors are schematically illustrated by a male connector 37′ and a female connector 37″. When the cover member is positioned and placed into the base portion 13, all of the connectors 37 mate, thus providing a continuous coil winding about the annular housing. This coil is connected to a supply source 38 which may be a variable dc or ac source whereby to control the intensity of the magnetic field. The spiral wire windings 35 are maintained in position by suitable means such as an epoxy coating 39 or any other suitable coating to maintain the wires and connectors in position. In fact, it is also conceivable that the coils 35 be provided on the inside wall of the insulation layers 15 and 15′.

Figure 4:
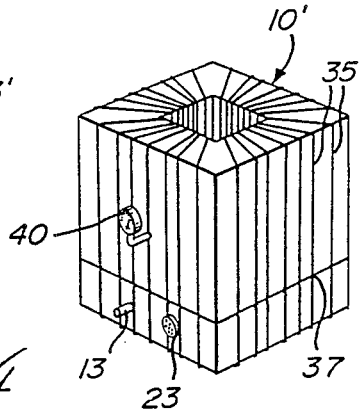
FIG. 4 is a perspective view showing the annular oven having a square cross section.

FIG. 4 shows another embodiment of the construction of the oven 10 of the present invention, and as herein shown, it is constructed as a square annular chamber 10′. A pressure gauge 40 may be provided in a side wall of the cover base portion to monitor the pressure inside the chamber 12. In a typical treatment of two coils formed of amorphous steel ribbon, they were treated at a temperature of about 400° C. for six hours while being subjected to an electromagnetic field by applying a current of 300–500 amps over that period of time. Of course, this is only one example of the treatment and various combinations of temperatures and electromagnetic field intensities are possible depending on the physical parameters of the coils being treated.

It is within the ambit of the present invention to cover any obvious modifications of the examples of the preferred embodiment described herein, provided such modifications fall within the scope of the appended claims.

We claim:

1. An oven for thermo-magnetic treatment of toroidal coils of amorphous ferro-magentic ribbon material to improve the eddy current and hysteresis losses thereof for utilization in a distribution transformer construction, said oven comprising a housing formed as an annular chamber defined by a base portion and a detachable cover portion, a thermo insulating material disposed over an interior surface of said base and cover portions, said annular chamber defining an open-ended central vertical passage, a coil of electrically conductive wire disposed about said chamber and extending about the vertical cross section of said chamber through said central vertical passage to encircle said base and cover portions all along said annular chamber, said coil of conductive wire being separable by detachable connector means to permit said cover portion to be detached from said base portion, at least two annular support heater discs inside said annular chamber and between which a coil of said amorphous ribbon material may be disposed for heating the toroidal windings of said ribbon material from the end edges thereof, means to apply controlled heat to said heater discs, and means to apply a current to said coil of electrically conductive wire to generate a controlled magnetic field about said chamber to orient the ferromagnetic domains in said amorphous ribbon material when positioned in said chamber.

2. An oven as claimed in claim 1 wherein said heater discs are each comprised of a composite annular plate of thermo conductive metal, said composite annular plate being constituted by a pair of metal plates having a resistive electrically insulating wire sandwiched therebetween.

3. An oven as claimed in claim 2 wherein said resistive electrically insulating wire is shaped in a zig-zag configuration and disposed between two mica sheets intermediate said pair of metal plates.

4. An oven as claimed in claim 2 wherein said means to apply controlled heat comprises a variable current source connected to individual ones of said heater discs, and a thermocouple connected to each said heater discs to sense the temperature thereof.

5. An oven as claimed in claim 2 wherein there is provided two or more sets of said at least two heater discs to support and apply controlled heat to two or more coils of amorphous sheet material, simultaneously.

6. An oven as claimed in claim 1 wherein said base portion is an annular trough-shaped base formed of thermo insulating material, said cover portion also being formed as an inverted trough-shaped member and dimensioned to be received in said base for sealing engagement therewith with said connector means of said coil in electrical engagement.

7. An oven as claimed in claim 6 wherein there is further provided vacuum means connected to said chamber for heating said coil of amorphous ribbon material in a neutral vacuum environment.

8. An oven as claimed in claim 6 wherein there is further provided an inert gas source connected to said chamber for heating said coil of amorphous ribbon material in an inert gas environment.

9. An oven as claimed in claim 6 wherein said thermo insulating material is a fiberglass insulation, or a silica insulation.

10. An oven as claimed in claim 6 wherein said connector means comprises a plurality of electrical connectors disposed about the inner and outer circumference of said annular trough-shaped base and cover portions.

11. An oven as claimed in claim 1 wherein said annular chamber is a circular ring chamber.

12. An oven as claimed in claim 1 wherein said annular chamber is a square ring chamber.

* * * * *